United States Patent [19]

Okano et al.

[11] Patent Number: 5,045,365

[45] Date of Patent: Sep. 3, 1991

[54] PROCESS FOR PRODUCING METAL FOIL COATED WITH FLAME SPRAYED CERAMIC

[75] Inventors: Norio Okano, Shimodate; Mitsuhiro Inoue, Oyama; Hiroshi Hasegawa, Shimodate, all of Japan

[73] Assignee: Hitachi Chemical Company, Ltd., Tokyo, Japan

[21] Appl. No.: 406,363

[22] Filed: Sep. 12, 1989

[30] Foreign Application Priority Data

Sep. 14, 1988 [JP] Japan ..... 63-230670
Sep. 14, 1988 [JP] Japan ..... 63-230671

[51] Int. Cl.[5] ..... B05D 1/08; B05D 1/10

[52] U.S. Cl. ..... 427/423; 427/398.3; 118/69

[58] Field of Search ..... 427/423, 34, 398.3; 118/69

[56] References Cited

U.S. PATENT DOCUMENTS 3,679,418 7/1972 Stroszynski ..... 427/34 X
3,681,121 8/1972 Rizzo ..... 427/398.3
3,906,769 9/1975 Maslowski ..... 427/423 X
4,215,160 7/1980 Rosenberg et al. ..... 427/398.3
4,600,599 7/1986 Wallsten ..... 427/34
4,713,289 12/1987 Hasegawa et al. ..... 428/246

FOREIGN PATENT DOCUMENTS 0263469 4/1988 European Pat. Off. .
2120899 8/1972 France .
2534494 4/1984 France .
62-231155 10/1986 Japan .
809956 3/1959 United Kingdom .
1356782 6/1974 United Kingdom ..... 427/398.3

*Primary Examiner*—Shrive Beck
*Attorney, Agent, or Firm*—Antonelli, Terry, Stout & Kraus

[57] ABSTRACT

A metal foil coated with flame sprayed ceramic is produced in high productivity by flame spraying a ceramic on a surface of a metal foil, while spraying the rear side of the metal foil to be flame sprayed with water from an array of water nozzles arranged across the metal foil for cooling and providing tension to the metal foil.

13 Claims, 3 Drawing Sheets

PROCESS FOR PRODUCING METAL FOIL COATED WITH FLAME SPRAYED CERAMIC

BACKGROUND OF THE INVENTION

This invention relates to a process for producing a metal foil coated with flame sprayed ceramic with high productivity.

Flame spraying of ceramic is widely known as an effective technique for ceramic coating. Especially, ever since advent of this flame spraying technique, by taking advantage of its excellent mass productivity, it has been popularly used for the improvement of surface qualities such as wear resistance, heat resistance, surface hardness, electrical insulating properties, heat insulating properties, etc., of mostly metallic products.

However, use of this technique, namely flame spraying of ceramic, for forming a ceramic coat on a thin metal foil involves a serious problem. It originates in the principle of this technique according to which a flame spray coating material, or ceramic, is supplied into an ultra-high temperature atmosphere such as oxygen-acetylene gas combustion flames or plasma flames of argon gas, nitrogen gas, helium gas or the like to melt the coating material (ceramic) and the melt is hit against the surface of the object to be coated (metal foil), and then cooled and solidified.

Generally, when ceramic is flame sprayed to a metal foil under the conditions used for the ordinary objects to be coated such as metal plates, metal rolls and the like, the heat of ceramic which adhered in a molten state to the metal foil during flame spraying operation is accumulated in the metal foil to cause its oxidation or its fusion and partial break, making it unable to obtain a satisfactory product.

A conceivable measure for overcoming this problem is to provide air nozzles on both sides of spray gun and perform flame spraying while blowing cold air against the object surface. This method, however, is still unable to prevent discoloration or break of the metal foil in the course of flame spraying.

As a result of many and various studies on the subject matter, the present inventors were convinced that in order to obtain a ceramic flame sprayed metal foil free of defects by using the conventional techniques, there is no other effective means but to perform the flame spraying operations under the conditions which can minimize the influence of heat on the metal foil. This necessitates a reduction of output of the spray gun and to notably reduce the ceramic spray rate per unit time.

This method is indeed capable of producing an excellent metal foil coated with flame sprayed ceramic, but it has a serious drawback. That is, this method is excessively low in productivity because of reduced output of spray gun and very low ceramic spray rate per unit time which are inevitable for minimizing the influence of heat on the metal foil.

The spray rate of ceramic per unit time is in almost direct proportion to film forming rate of ceramic layer, so that an excessive lowering of spray rate leads to a marked reduction of productivity. Also, reduced output of spray gun lowers the temperature of flames for melting ceramic, which retards melting of ceramic. Therefore, even if the ceramic feed into spray gun is unchanged, there may take place imperfect melting of ceramic if the output of spray gun is low, and also the molten ceramic becomes hard to adhere to the object because of low temperature, resulting in a low coating efficiency.

Due to these problems, productivity was very low in forming a ceramic coat on metal foils by flame spraying of ceramic with the conventional techniques, and such flame spray coating on metal foils would take 10 to 20 times as much time as required for flame spray coating to an object with a large thickness such as metal plates. Thus, mass production of metal foils coated with flame sprayed ceramic has been quite impossible in the prior art.

On the other hand, U.S. Pat. No. 4,713,284 discloses a process for producing a ceramic coated laminate wherein flame spraying of a ceramic powder is conducted on a copper foil running on a cooling roll in which cooling water is passed. This process has a disadvantage in that discoloration takes place probably due to loss of heat by the roll-constituting material and insufficient cooling capacity.

SUMMARY OF THE INVENTION

The present invention is intended to eliminate said defects of the prior art and to provide a high-productivity process for producing a metal foil coated with flame sprayed ceramic.

The present invention provides a process for producing a metal foil coated with flame sprayed ceramic, which comprises flame spraying a ceramic on a surface of a metal foil, while keeping the rear side of the metal foil to be flame sprayed in contact with water for cooling and giving a tension to the metal foil.

DESCRIPTION OF THE PREFERRED EMBODIMENTS

Figure 1:
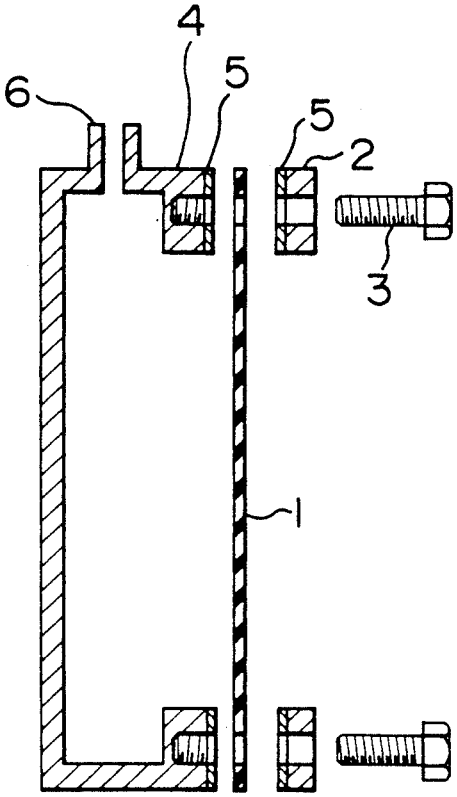
FIG. 1 and FIG. 2 are sectional views illustrating an embodiment of the present invention using a water tank.

The present invention pertains to a process for producing a metal foil coated with flame sprayed ceramic, which comprises flame spraying a ceramic on a surface of a metal foil while keeping the rear side of the metal foil to be flame sprayed in contact with water for cooling and giving a tension to the metal foil. Said process of this invention can be practiced in various ways.

In a mode of practice of this invention, the object to be flame sprayed, viz. a metal foil, is fixed at the opening of a water tank in such a way as to close said opening, and ceramic is flame sprayed to the metal foil while cooling the metal foil and also giving a tension thereto by applying water pressure with water filling said water tank.

According to another mode of practice of this invention, a plurality of water spray nozzles are provided just beneath the rear side of the metal foil to be flame sprayed, and flame spraying is performed by keeping said rear side of the metal foil in contact with water ejected from said nozzles.

In the prior art, cooling of the object to be flame sprayed has been mostly performed by a method in which compressed air from air nozzles attached to a spray gun is blown against the flame sprayed object surface. According to this method, however, when the object to be flame sprayed is a thin metal foil, since such metal foil is small in thickness and heat capacity, the heat given to the metal foil during flame spraying tends to accumulate in the metal foil, giving rise to a possibility to causing discoloration or fusing of the metal foil by the accumulated heat. Insifficient cooling is responsible for such a phenomenon. Therefore, in order to accomplish flame spraying of ceramic on a metal foil at high efficiency and without causing defects such as discoloration and fusion break of the metal foil, it is necessary to apply a cooling method with a high cooling capacity in place of the conventional air cooling method.

Many researches have been made for an effective cooling method by the present inventors, and as a result, the inventors found that flame spraying of ceramic to a metal foil can be performed in a notably effective and advantageous way by a method in which the object to be flame sprayed, namely a metal foil is fixed above the opening of a water-filled tank, and ceramic is flame sprayed to the metal foil while applying water pressure thereto.

According to this method, since the rear side of the metal foil to be flame sprayed is always cooled as it is in contact with water in the water tank, the heat transferred to the metal foil in the course of flame spraying operation is instantaneously conveyed into water contacting the rear side of the metal foil, whereby the metal foil is prevented from being overheated in the flame spraying operation. In the present invention, water pressure is further applied to the metal foil by filling the water tank with water in the flame spraying operation. Such application of water pressure is intended to assure sufficient contact of the rear side of the metal foil with water in the water tank and to impart a proper tension to the metal foil. Giving tension to the metal foil proves effective for preventing the metal foil from wrinkling during flame spraying. More specifically, when ceramic is flame sprayed to a metal foil, ceramic adheres on the metal foil at a high temperature near the melting point of ceramic and then instantaneously cooled down to normal temperature to undergo sudden shrinkage. Also, the metal foil and ceramic are different in coefficient of thermal expansion. Therefore, when ceramic is flame sprayed in a large amount to a metal foil without giving a tension thereto, the metal foil tends to wrinkle. However, when a proper tension is given to the metal foil in the flame spraying operation, the stress generated by sudden shrinkage of flame sprayed ceramic is absorbed by the metal foil to keep it from being wrinkled.

Further studies on other effective cooling methods by the present inventors also revealed that it is effective to employ a method in which flame spraying is performed under cooling and tension by ejecting water in the fashion of a shower against the rear side of the metal foil from a plurality of water spray nozzles disposed therebelow.

In this arrangement, water ejected in the form of showers from water spray nozzles impinges against the rear side of the metal foil to quickly take away heat transferred to the metal foil in the flame spraying operation. This makes it possible to prevent the metal foil from being overheated during flame spraying. Further, a tension is afforded to the metal foil by water pressure applied thereto by ejection of water from spray nozzles.

Various means and methods are conceivable for cooling the rear side of metal foil with water. Use of water spray nozzles in the present invention is for the following advantage. That is, it is possible to moisten the rear side of metal foil uniformly with a small amount of water since water ejected from spray nozzles is shower-like and spread in all directions in the form of droplets. Also, as the rear side of metal foil is always showered with fresh cold water, a constant cooling performance is maintained.

It is important that the rear side of metal foil to be flame sprayed be kept cooled uniformly without fail. If there is a portion left uncontacted with water, such a portion is bound to incur certain trouble such as discoloration at the time of flame spraying. Therefore, in order to perform flame spray coating at high efficiency, it is necessary to provide a plurality of spray nozzles so that cooling can be effected evenly throughout the length and width of the object to be coated.

In the above-described method, flame spraying of ceramic on a metal foil is performed according to a so-called batch system. However, for achieving a further improvement of productivity, it is recommended to employ a system in which a rolled-up metal foil is delivered out from the roll and, after flame sprayed with ceramic, wound up on a take-up roll successively.

Thus, the process for producing a metal foil coated with flame sprayed ceramic according to the present invention can be also accomplished in the following way. In the course of travel of metal foil delivered out from a roll till it is wound up on a take-up roll, the rear side of the metal foil, opposite from its side to be coated, is showered with water ejected from spray nozzles to effect cooling while giving a tension to the metal foil, and the upper side (the side to be coated) of the thus cooled and tensed metal foil is flame spray coated with ceramic by a spray gun which is moved reciprocatively across the width of metal foil.

The present inventors found that it is very effective for the purpose of this invention to keep the rear side of metal foil contacted with water applied thereto in the fashion of a shower from an array of spray nozzles. That is, a plurality of spray nozzles are provided in direct opposition to the rear side (opposite from the side to be coated) of metal foil and water is ejected from said spray nozzles so that the rear side of said metal foil is showered with water to cool the metal foil.

In this case, since water ejected from spray nozzles forms a shower and constantly impinges against the rear side of metal foil, the heat transferred to the metal foil in the flame spraying operation is always passed into cold water contacted with the rear side of metal foil, thus keeping the metal foil safe from overheating. Also, since water ejected from spray nozzles forms a shower, the rear side of metal foil is moistened uniformly and thoroughly. Further, it is possible to cool the rear side of metal foil in its entirety by arranging a plurality of spray nozzles at suitable intervals. It is very important to cool the rear side of metal foil uniformly and exhaustively, because if a portion is left uncontacted with water, such a portion incurs certain trouble such as discoloration in the course of flame spraying. It is therefore essential to provide a plurality of spray nozzles. It is to be also noted that water pressure developed by ejection of water gives a tension to the metal foil, such a tension being helpful to prevent the metal foil from being wrinkled.

Another feature of the present invention is that the metal foil coated with flame sprayed ceramic can be obtained continuously by using a roll of metal foil which, in operation, is delivered out from the roll and, after flame spray coated with ceramic, wound up on a take-up roll, thus allowing continuous obtainment of coated metal foil.

Presently, metal foil is supplied mostly as a roll. Therefore, when conventional flame spraying method is applied, the rolled-up metal foil must be cut to a desired size on occasion and fixed to flame spraying jigs, and after flame spray coating, the coated metal foil must be separated from said jigs. These operations are carried out repeatedly.

However, when metal foil is delivered out from its roll and taken up on the other roll and flame spraying is performed in the course of said transfer of metal foil, it is possible to obtain ceramic flame sprayed metal foils continuously, which provides further improvement of mass productivity.

As described above, water ejected from spray nozzles in the form of a shower hits against the rear side of metal foil to quickly take away heat transferred to the metal foil during flame spraying, thus preventing the metal foil from being overheated in the flame spraying operation.

In the present invention, as mentioned above, it is preferred to employ a method in which flame spraying of ceramic on metal foil is performed in the course of transfer of metal foil from its stock roll to a coated metal foil take-up roll. This method is excellent in productivity as compared with the conventional batch type method in which flame spraying is conducted after cutting the metal foil and securing it to proper jigs. According to the method of this invention, it is possible to form flame sprayed ceramic coat on metal foil continuously with no need of cutting the roll of metal foil. However, in the above-said method in which flame spraying is performed in the course of transfer of metal foil from its stock roll to a take up, the metal foil is moving during the time when flame spraying is conducted in the conventional system. It was therefore difficult to fix both ends of the side to be flame sprayed of the metal foil. Consequently, the flame spray coated metal foil would be creased due to deformation caused by difference in heat shrinkage between ceramic and metal foil at the time of flame spraying.

In the present invention, in order to solve this problem, flame spray coating of ceramic on metal foil is conducted by once stopping the delivery and take-up means to let the metal foil stay stationary and fixing the edge of the section to be flame sprayed. This has made it possible to prevent deformation of the ceramic flame spray coated metal foil due to difference in heat shrinkage between ceramic and metal foil at the time of flame spraying.

Thus, according to the modified method of this invention, it is possible to obtain excellent ceramic flame spray coated metal foils free of creases while maintaining high productivity of the method in which flame spraying is performed while the rolled metal foil is delivered out and taken up after coated.

Figure 6:
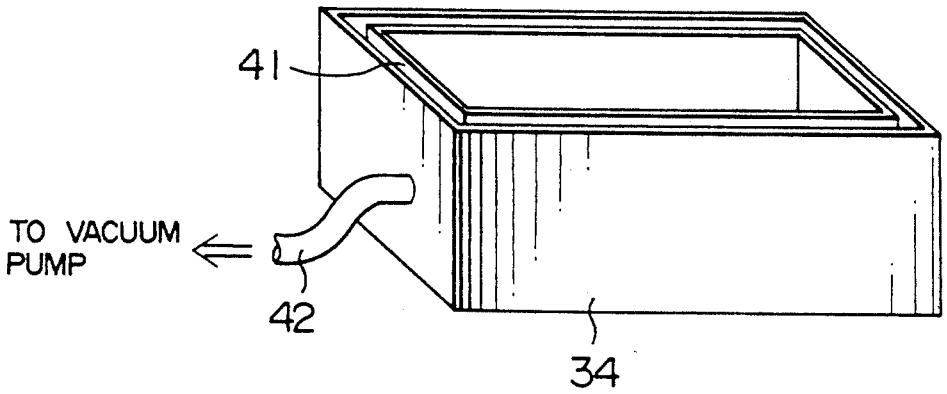
FIG. 6 is a perspective view of a suction device used in the above embodiment of the invention.

For fixing the edge of the section to be flame sprayed of metal foil, a method can be used in which the metal foil is clamped along its edge from the upper and lower sides by using a suitable cylinder means such as air cylinder or hydraulic cylinder. It is also possible to use a suction means 34 such as shown in FIG. 6 in which an open space 41 is provided so that the edge of the section to be flame sprayed of the metal foil may be placed thereon, and the air in said space 41 is sucked out by a vacuum pump so that the edge of the metal foil is fastly attached to the opening of said space 41.

The metal foils usable in this invention include various types of ordinarily used metal foils such as copper foil, nickel foil, aluminum foil, zinc foil, silver foil, stainless steel foil, invar alloy foil, etc., and alloys thereof, clad foils and the like. Among them, copper foil is very useful and especially preferred as it is most tractable for forming a circuit layer when a ceramic flame sprayed copper foil is used in a printed wiring board.

As ceramic which is flame sprayed to metal foil, there can be used alumina, titania, zirconia, calcia, magnesia, barium titanate, chromia, mullite, spinel, cordierite, and the like. Among them, alumina and mullite are preferred as they have been practically used as ceramic substrate for printed wiring boards For flame spraying of ceramic, there can be employed the ordinary ceramic flame spraying methods such as gas flame spraying method, plasma flame spraying method, explosion flame spraying method, water plasma flame spraying method, etc.

For movement of spray gun, a method can be employed in which a spray gun is securely attached to a driving means such as traverser, robbot, etc., and moved over the surface to be flame sprayed of metal foil. The direction of movement is free to choose, but usually a method in which the spray gun is moved reciprocatively in the direction orthogonal to the coated metal foil take-up direction is preferred as the mechanism of the spray gun driving means is simple and also the thickness of ceramic flame spray coating can be easily controlled by properly selecting and combining the spray gun moving speed and metal foil take-up rate.

According to the conventional techniques, the coated metal foils tended to suffer from trouble such as discoloration or fusion break, and in order to prevent such trouble, it was necessary to excessively lower the output of spray gun and to minimize the flame spray rate per unit time. The conventional techniques, therefore, were very low in mass productivity and incapable of application to industrial production of metal foils coated with flame sprayed ceramic.

According to the method of this invention, since the rear side of the metal foil to be flame sprayed is incessantly cooled as it is showered entirely and uniformly with water ejected from spray nozzles provided beneath said metal foil, heat of flame spraying is quickly taken away to prevent said heat trouble and it is possible to perform flame spray coating at the same output and spray rate as flame spraying on ordinary bulk materials. Beside, mass productivity is markedly improved.

Mass productivity can be even bettered when flame spraying is carried out continuously by deliverying out the metal foil from its stock roll and taking up the coated metal foil successively.

Further, in the present invention, since the delivery and take-up means are once stopped to let the metal foil stay stationary and the edge of the section to be flame sprayed of the metal foil is fixed in the course of the flame spraying operation, it is possible to prevent deformation caused by difference in heat shrinkage between ceramic and metal foil, so that excellent copper foils coated with flame sprayed ceramic can be obtained.

The present invention will be described more particularly with reference to Examples thereof.

EXAMPLE 1

An embodiment of the invention is described with reference to FIGS. 1 to 3.

Figure 2:
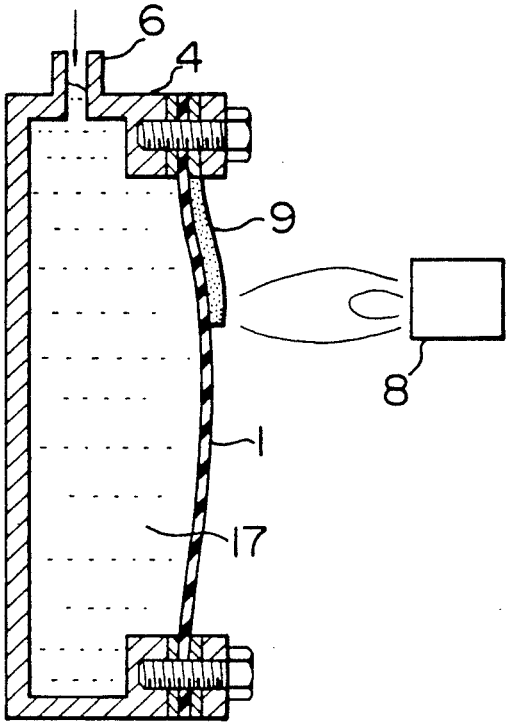

FIGS. 1 and 2 are sectional views illustrating an embodiment of the invention where a water tank is used for effecting cooling.

As shown in FIG. 1, a copper foil 1 having a thickness of 18 μm was set at the opening of a water tank 4 so as to close the opening and secured in position by using frames 2 and bolts 3. A rubber thread sealant 5 was bonded to those parts of frame 2 and water tank 4 which were attached to copper foil 1 for preventing water leakage when water tank 4 was filled with water.

Then, as shown in FIG. 2, water 7 was supplied into water tank 4 from water inlet 6 until water pressure in the tank reached 0.4 $kgP/cm^2$.

Thereafter, copper foil 1 secured to water tank 4 filled with water 7 was flame sprayed with alumina by using a plasma flame spray gun 8 to form a 100 μm thick flame sprayed alumina coat 9 on said copper foil 1. The flame spray gun output in this operation was set at 900 A (in terms of electric current applied) which was equal to or higher than the flame spray gun output usually used in flame spraying for bulk materials, thick metal plates and the like. The alumina feed rate was 35 g/min. Copper foil 1 formed with said flame sprayed alumina coat 9 suffered no discoloration or break due to oxidation and was free of wrinkles that might be caused due to difference in thermal expansion between alumina and copper foil. The time required for forming the 100 μm thick alumina coat was 5 minutes per 500 $mm^2$.

For the purpose of comparison, a similar flame spraying operation was carried out at the same spray gun output as in the above-described example of the invention, without supplying water into the water tank. In this case, discoloration took place immediately after start of flame spraying, and also fusion break occurred soon in the copper foil. Even when the water tank was not filled with water, it was possible to prevent occurrence of oxidation, break and creasing of the copper foil by reducing the flame spray gun output, but in this case, the time required for forming a 100 μm thick alumina coat was 50 minutes or more per 500 $mm^2$, which signifies very poor productivity.

Figure 3:
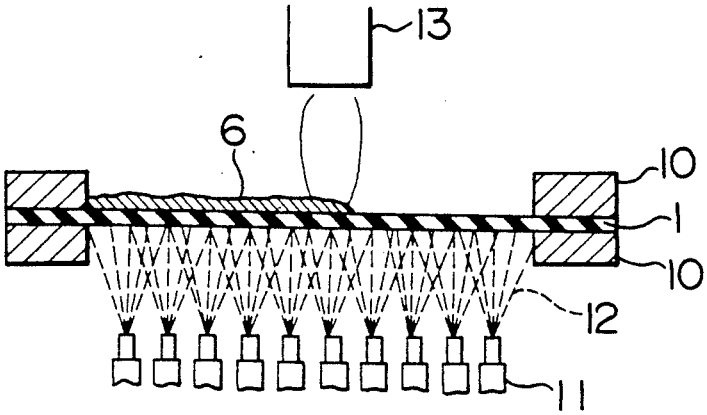
FIG. 3 is a sectional view illustrating another embodiment using a plurality of squarely arranged water spray nozzles.

Referring now to FIG. 3, there is shown a sectional view of another embodiment of the invention using water spray nozzles.

In this example, a copper foil 1 having a thickness of 18 μm and a size of 500 $mm^2$ was fixed in position by using fixing frame 10. Below the underside of said copper foil 1, there were provided a plurality of water spray nozzles 11 arranged squarely at an interval of 50 mm in lines of ten both ways, totalling 100. Water 12 was ejected from said spray nozzles 11 in the fashion of a shower so that the sprayed water would hit the underside of copper foil 1 exhaustively and uniformly to cool the copper foil throughout the length and width thereof. With such cooling of the underside of copper foil by water showers being continued, flame spraying of alumina was performed on the upper side of copper foil by using a plasma flame spraygun 13 to form a 100 μm thick flame sprayed alumina coat 14. The plasma flame spraygun output in this operation was set to a working electric current of 900 A and an alumina feed rate of 50 g/min, which were equal to or higher than those used for flame spraying to ordinary bulk materials and not appliable to flame spraying for metal foils with the conventional techniques.

The alumina flame spray coated copper foil obtained in the manner described above suffered no discoloration and break due to overheating which has been a serious problem in the prior art. Thus, by cooling the underside of copper foil with water ejected from spray nozzles, it was possible to form an excellent alumina flame spray coated copper foil free of discoloration or break with a spraygun output equal to or higher than the plasma flame spraygun output used for flame spraying on ordinary bulk materials. In the conventional flame spraying method conducted by reducing the flame spraying output for preventing discoloration, the time required for forming a 100 μm thick flame sprayed alumina coat on a 500 $mm^2$ copper foil was 50 minutes or more, whereas according to the method of this invention, said time is 5 minutes, or less than 1/10 of the time required in the prior art. Thus, the method of this invention enabled a remarkable enhancement of mass productivity.

According to the method of this invention, as described above, the rear side of the metal foil to be flame sprayed is kept in contact with water and thereby always cooled, so that the heat conducted to the metal foil during flame spraying is transferred in an instant into water contacting the rear side of metal foil, thereby preventing oxidation, discoloration, deformation and break due of overheating of metal foil in the course of flame spraying operation.

Also, a tension can be given to the metal foil by applying water pressure thereto by filling the water tank with water during the flame spraying operation, and this tension serves for absorbing stress caused by sudden heat shrinkage of ceramic at the time of flame spraying, by which it is possible to prevent wrinkling of the metal foil.

It will be appreciated from the above that the method of this invention can realize high-output flame spraying for metal foils, which has been impossible with the prior art, and is also capable of markedly improving mass productivity of flame spray coated metal foils.

EXAMPLE 2

Figure 4:
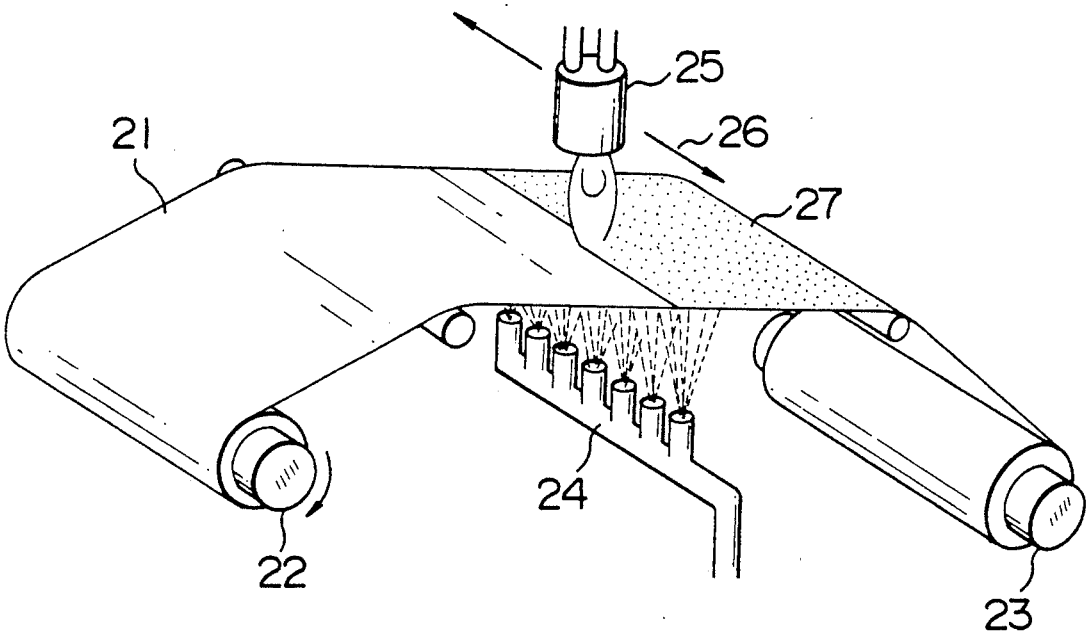
FIG. 4 is a schematic perspective view illustrating flame spraying of alumina to a copper foil according to a method of the present invention.

Another mode of practice of the present invention is here described with reference to FIG. 4.

A copper foil 21 measuring 18 μm in thickness and 540 mm in width was used as the object to be flame spray coated, and alumina was used as flame spray coating material. As shown in FIG. 4, copper foil 21 was delivered out from its feed roll 22 and, after coated, wound up on a take-up roll 23. At a position between said feed roll 22 and take-up 23 and below copper foil 21, there were disposed an array of water spray nozzles 24 transversely to the direction of movement of copper foil as shown in the drawing. There were used conical nozzles and fan-shaped nozzles. These nozzles 24 were arranged vertically to copper foil 21 and so adjusted that water ejected from said nozzles 24 would impinge against the underside of copper foil 21 thereabove in its entirety along the width of copper foil in which direction the nozzles 24 were arranged. With such cooling of the underside of copper foil with water shower being continued, flame spraying of alumina was performed on the opposite side, namely the upper side of copper foil 21 by using a plasma flame spraygun 25. Spraygun 25 was secured to a traverser and moved reciprocatively in the direction of arrow 26 along the center line of the portion of copper foil 21 of which the underside was showered with water from spray nozzles 24. The output conditions of said plasma flame spraygun 25 were adjusted to a flame spray electric current of 900 A and an alumina feed rate of 50 g/min, which are equal to or higher than those used for flame spray coating of ordinary bulk materials or thick metal plates. The copper foil take-up rate was set at 100 mm/min, and a 100 μm thick alumina flame spray coat 27 was formed on copper foil 21.

The thus formed alumina flame-spray coated copper foil, owing to the cooling effect of its rear side with water, was perfectly free of discoloration and break due to overheating which has been a baffling problem in the prior art. Regarding the time required for forming a 100 m alumina coat on a copper foil with a size of 500 $mm^2$, more than 50 minutes were required in the conventional method in which the flame spraying output must be reduced for preventing occurrence of discoloration, but according to the method of this invention, the time needed for forming said alumina coat was 5 minutes, or less than 1/10 of the time required in the prior art. Thus, the method of this invention enabled a marked rise of productivity.

As described above, according to the method of this invention, it is possible to perform flame spray coating of metal foils at the same operating output and the same flame spraying rate as used for flame spray coating on ordinary bulk materials. This has been impossible with the conventional methods. It is also remarkable that the method of this invention has realized a noticeable improvement of mass productivity.

Further, the method of this invention is capable of continuous performance of flame spray coating of metal foils, which enables further enhancement of mass productivity.

EXAMPLE 3

Figure 5:
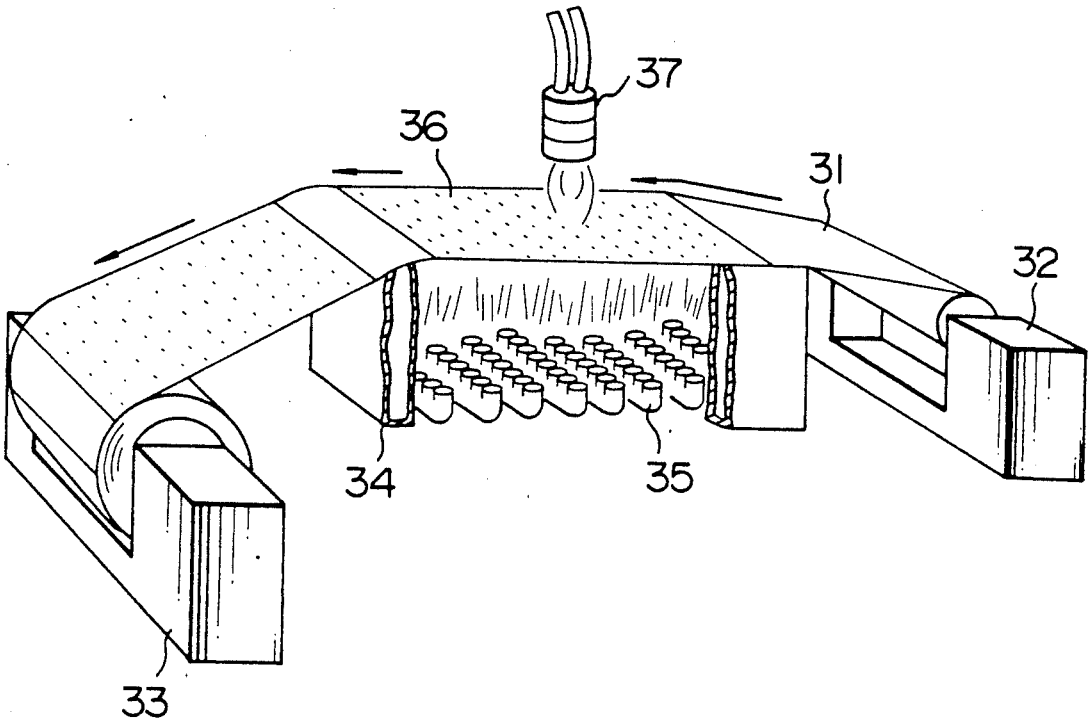
FIG. 5 is a schema illustrating a mode of alumina flame spraying to a copper foil according to another embodiment of the present invention.

Still another embodiment of this invention is illustrated with reference to FIGS. 5 and 6. In this embodiment, rolled copper foil 31, 540 mm wide and 18 μm thick, is delivered out from a payoff device 32 and wound up on a take-up device 33. In operation, said payoff device 32 and take-up device 33 are once stopped to let copper foil 31 stay stationary, and the stationary copper foil 31 is fastly secured by suction force to the opening 41 of a suction device 34 disposed on the lower side of copper foil 31. A perspective view of said suction device 34 is shown in FIG. 6 Said suction device 34 has opening 41 at its side contacting copper foil 31, that is, at the top of the device, and said opening 41 is designed to encompass the rear side of copper foil 31, that is, the side opposite from the flame sprayed side 36.

Suction device 34 is connected to a vacuum pump (not shown) by hose 42 so that, in operation, the air in said opening 41 is sucked out to let the edge of copper foil 31 attach fast to the top end of said opening 41.

The rear side of copper foil fixed at its edge in the manner described above was showed with water ejected from a plurality of water spray nozzles 35 disposed below the rear side of copper foil 31, namely inside the suction device 34, to cool copper foil 31. There were provided 100 water spray nozzles 35 for effecting uniform cooling of the entirety of rear side of copper foil to be flame sprayed. While conducting such cooling of the rear side of copper foil, flame spraying was performed on the upper side 36 by using a plasma flame spraygun to form a 100 μm thick flame sprayed alumina coat. The output of the plasma flame spraygun in this operation was as follows: flame spray electric current=900 A, alumina feed rate=50 g/min, which are equal to or higher than those used for flame spray coating of ordinary bulk materials and were not appliable to flame spray coating of metal foils in the prior art.

After completing alumina flame spraying on one section 36 of copper foil in the manner described above, vacuum fixing of the edge of said section 36 was released and the payoff and take-up devices 32 and 33 were operated to bring the next section to be flame sprayed of copper foil 31 to the prescribed position.

By repeating the above-described process, flame spray coating was performed continuously on copper foil 31 which has been rolled up, without cutting the foil.

The thus obtained copper foil 31 coated with flame sprayed alumina suffered no discoloration or break due to overheating of copper foil, which has been one of the serious problems in the prior art. There was also observed no deformation nor wrinkling of copper foil due to difference in heat shrinkage between alumina and copper foil at the time of flame spraying. That is, according to the present invention, discoloration or break of copper foil due to overheating could be prevented by cooling the rear side (the side reverse to the flame sprayed side 36) of copper foil with water ejected from water spray nozzles 35. Also, deformation or wrinkling of copper foil caused by difference in heat shrinkage between alumina and copper foil during the flame spraying operation could be prevented by fixing the edge of the section to be flame sprayed of copper foil 31 to the opening 41 of a suction device 34 by the vacuum suction force.

As a result, the present invention has realized a marked reduction of time required for flame spray coating on metal foils. For instance, in case of forming a 100 μm thick flame sprayed alumina coating on a 540 $mm^2$ foil surface, more than 50 minutes were required in the conventional method in which the flame spraying output must be reduced for preventing discoloration. However, according to the method of this invention, there is required only 5 minutes, or less than 1/10 of the time needed in the conventional method. This naturally enabled a marked enhancement of mass productivity of flame spray coated metal foils. Further, according to a method of this invention, the rolled-up copper foil can be flame spray coated without cutting the foil by performing flame spraying in the course of transfer of copper foil which is delivered out from a feed roll and wound up on a take-up roll.

As described above, according to the present invention, there is provided a process for producing a metal foil coated with flame sprayed ceramic, which comprises a step in which ceramic flame spray coating on a metal foil, which is delivered out from its payoff device toward a take-up device, is performed by once stopping said payoff and take-up devices to let the metal foil stay stationary and fixing the edge of the section to be flame sprayed of metal foil while cooling the rear side of metal foil by showering it with water ejected from water spray nozzles disposed below said metal foil, and a step in which after a flame sprayed ceramic coat has been formed on a section of metal foil, said payoff and take-up means are operated to bring the next section to be flame sprayed of metal foil to the prescribed position, the above two steps being carried out repeatedly. By using the above method, it is possible to perform flame spray coating of ceramic on metal foils at a flame spraying output equal to or higher than that used for flame spraying coating on ordinary bulk materials without causing discoloration or break of metal foil due to be overheating thereof while also preventing deformation or wrinkling of metal foil due to difference in heat shrinkage between ceramic and metal foil at the time of flame spraying. Further, the described process for producing metal foils coated with flame sprayed ceramic according to this invention is remarkably high in mass productivity.

What is claimed is:

1. A process for producing a metal foil coated with flame sprayed ceramic, which comprises positioning a metal foil substantially horizontally between a pair of parallel rolls, flame spraying a ceramic on an upper surface of the metal foil, while contacting a rear side of the metal foil, on which the ceramic is flame sprayed, with water by ejecting water from a plurality of water spray nozzles disposed below and transversely across the rear side of the metal foil so that tension is given to the metal foil by water pressure across the metal foil.

2. The process according to claim 1, wherein the metal foil is a copper foil.

3. The process according to claim 1, wherein the flame sprayed ceramic is a material principally composed of alumina.

4. The process according to claim 1, wherein the flame sprayed ceramic is a material principally composed of mullite.

5. A process for producing a metal foil coated with flame sprayed ceramic, which comprises carrying out flame sprayed coating of ceramic on a metal foil by delivering the rolled metal foil from a stock roll and taking up the coated metal foil on a take-up roll, wherein the metal foil delivered from the positioned halfway in its transfer from stock roll to take-up roll is flame spray coated with ceramic by a spraygun moved thereabove reciprocatively and across the metal foil while contacting the rear side of the metal foil with water rejected from a plurality of water spray nozzles disposed below the rear side of the metal foil, said water spray nozzles being arranged transversely to the direction of delivery of the metal foil so that tension is given to the metal foil on which the ceramic is flame sprayed by water pressure applied across the metal foil.

6. The process according to claim 5, wherein the flame sprayed ceramic is a material principally composed of mullite.

7. The process according to claim 5, wherein the metal foil is a copper foil.

8. The process according to claim 5, wherein the flame sprayed ceramic is a material principally composed of alumina.

9. A process for producing a metal foil coated with flame sprayed ceramic, comprising a step of forming a flame sprayed ceramic coating on a section of metal foil delivered from a payoff device and positioned between said payoff device and a take-up device, wherein a flame sprayed ceramic coating operation is performed on said section of metal foil by once stopping said payoff and take-up devices to let the metal foil stay stationary and fixing edges of said section of metal foil while contacting a rear side of said section of metal foil between said edges with water ejected from a plurality of water spray nozzles disposed below and across the width of said section of metal foil so that tension is given to said metal foil by water pressure of the water impinging upon the rear side of the width of the metal foil, and a step in which after said flame sprayed ceramic coating has been completed, said payoff device and said take-up device are operated to bring a next section of metal foil to be flame spray coated to a prescribed position between the payoff device and said take-up device, said steps being carried out repeatedly.

10. The process according to claim 9, wherein fixing of the section of metal foil to be flame spray coated is effectuated by having said edges attached fast to the opening of a suction device by a sucking force.

11. The process according to claim 9, wherein the metal foil is a copper foil.

12. The process according to claim 9, wherein the flame sprayed ceramic is a material principally composed of alumina.

13. A process according to claim 9, wherein the flame sprayed ceramic is a material principally composed of mullite.

* * * * *